US007731389B2

(12) United States Patent
Draganov et al.

(10) Patent No.: US 7,731,389 B2
(45) Date of Patent: Jun. 8, 2010

(54) LIGHT SOURCE COMPRISING LIGHT-EMITTING CLUSTERS

(75) Inventors: Vladimir Draganov, Coquitlam (CA); Marc Salsbury, Vancouver (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 275 days.

(21) Appl. No.: 11/931,684

(22) Filed: Oct. 31, 2007

(65) Prior Publication Data

US 2008/0101064 A1 May 1, 2008

Related U.S. Application Data

(60) Provisional application No. 60/855,493, filed on Oct. 31, 2006.

(51) Int. Cl.
*F21V 33/00* (2006.01)

(52) U.S. Cl. ..... 362/231; 362/230

(58) Field of Classification Search ..... 362/231, 362/544, 545, 230, 249.06, 249.14, 228
See application file for complete search history.

(56) References Cited

U.S. PATENT DOCUMENTS

| | | | | |
|---|---|---|---|---|
| 1,266,554 | A * | 5/1918 | Coleman et al. | 362/517 |
| 2,029,543 | A * | 2/1936 | Reiss | 362/228 |
| 5,803,579 | A | 9/1998 | Turnbull et al. | |
| 6,200,002 | B1 | 3/2001 | Marshall et al. | |
| 6,357,893 | B1 * | 3/2002 | Belliveau | 362/285 |
| 6,513,949 | B1 | 2/2003 | Marshall et al. | |
| 6,523,976 | B1 | 2/2003 | Turnbull et al. | |
| 7,014,336 | B1 | 3/2006 | Ducharme et al. | |
| 2002/0014837 | A1 | 2/2002 | Kim et al. | |
| 2002/0140380 | A1 | 10/2002 | Biebl | |
| 2003/0043567 | A1 | 3/2003 | Hoelen et al. | |
| 2003/0053310 | A1 * | 3/2003 | Sommers | 362/231 |
| 2004/0105261 | A1 * | 6/2004 | Ducharme et al. | 362/231 |
| 2005/0077838 | A1 | 4/2005 | Blumel | |
| 2006/0226336 | A1 * | 10/2006 | York et al. | 250/206 |

FOREIGN PATENT DOCUMENTS

| | | | |
|---|---|---|---|
| JP | 2005203326 | A | 7/2005 |
| WO | 2004053827 | A2 | 6/2004 |

* cited by examiner

*Primary Examiner*—David V Bruce
(74) *Attorney, Agent, or Firm*—Mark L Beloborodov

(57) ABSTRACT

The present invention provides a light source for producing a substantially balanced output at a substantially optimised output intensity. In one embodiment, the light source comprises one or more light-emitting clusters of a first type and one or more light-emitting clusters of one or more other types, each one of which comprising one or more light-emitting elements, such that, when all light-emitting elements are driven to provide a substantially optimised output intensity, the spectral output of the one or more light-emitting clusters of the first type is substantially balanced by the spectral output of the one or more other light-emitting clusters.

26 Claims, 7 Drawing Sheets

LIGHT SOURCE COMPRISING LIGHT-EMITTING CLUSTERS

CROSS-REFERENCE TO RELATED APPLICATION

This application claims priority to U.S. Provisional Patent Application No. 60/855,493, filed Oct. 31, 2006, which is incorporated herein by reference.

FIELD OF THE INVENTION

The present invention pertains to the field of lighting and in particular to a light source comprising light-emitting clusters.

BACKGROUND

Advances in the development and improvements of the luminous flux of light-emitting devices such as solid-state semiconductor and organic light-emitting diodes (LEDs) have made these devices suitable for use in general illumination applications, including architectural, entertainment, and roadway lighting. Light-emitting diodes are becoming increasingly competitive with light sources such as incandescent, fluorescent, and high-intensity discharge lamps. Also, with the increasing selection of LED wavelengths to choose from, white light and colour changing LED light sources are becoming more popular.

The following provide examples of such light sources. In U.S. Pat. Nos. 5,803,579 and 6,523,976, an illuminator assembly incorporating light emitting diodes is described as having a plurality of LEDs on a vehicular support member in a manner such that, when all of the LEDs are energised, illumination exhibiting a first perceived hue (e.g., blue-green) and projected from at least one of the LEDs, overlaps and mixes with illumination exhibiting a second perceived hue (e.g., amber), which is distinct from said first perceived hue and which is projected from at least one of the remaining LEDs in such a manner that this overlapped and mixed illumination forms a metameric white colour and has sufficient intensity and colour rendering qualities to be an effective illuminator.

In U.S. Pat. No. 6,513,949, LED/Phosphor-LED hybrid lighting systems for producing white light are described as including at least one light emitting diode and phosphor-light emitting diode. The hybrid lighting system exhibits improved performance over conventional LED lighting systems that use LEDs or phosphor-LEDs to produce white light. In particular, the hybrid system permits different lighting system performance parameters to be addressed and optimised as deemed important, by varying the colour and number of the LEDs and/or the phosphor of the phosphor LED.

In U.S. Pat. No. 7,014,336, systems and methods for generating and modulating illumination conditions are disclosed to generate high-quality light of a desired and controllable colour, for creating lighting fixtures for producing light in desirable and reproducible colours, and for modifying the colour temperature or colour shade of light within a prespecified range after a lighting fixture is constructed. In one embodiment, LED lighting units capable of generating light of a range of colours are used to provide light or supplement ambient light to afford lighting conditions suitable for a wide range of applications.

In the above and other such light sources, by varying the relative power with which the individual LEDs of the light source are driven, it may become possible to vary the colour output of the light source. Likewise, by varying the overall power supplied to each LED, it becomes possible to vary the combined output intensity of the light source. When all the LEDs within the light source are driven to their respective maximum intensity, however, the combined spectral output does not generally correspond to a desired output, such as for example the white point at the centre of the CIE 1931 colour space chromaticity diagram. This often results from the fact that differently coloured LEDs generally have different output intensities and efficiencies. As such, the range of colours in these light sources for which maximum light output is achievable is biased to one or more of the constituent LED colours in the package(s) or cluster(s), generally the LED colour(s) having a higher output efficiency and/or capacity.

Consequently, it is generally not possible with currently available light sources to select a minimal number of LEDs (e.g. three LEDs in an RGB light source or package, or four LEDs in an RAGB light source or package) to minimise manufacturing costs while having each LED operate at an optimal output intensity such that a combined maximum output thereof is substantially centred at the white point of the CIE 1931 colour space chromaticity diagram, or around other such desirable combined outputs. For instance, this situation may also apply when designing light sources for which an optimal output intensity at a given colour, or within a given colour range, is desired.

Therefore, there is a need for an improved light source and lighting system that overcomes some of the drawbacks of the above and other known light sources.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a light source comprising light-emitting clusters. In accordance with an aspect of the present invention, there is provided a light source for producing a spectral output at an output intensity, the light source comprising: one or more light-emitting clusters of a first type, each one of which comprising a first combination of one or more light-emitting elements in each of at least a first, a second and a third colour; one or more light-emitting clusters of a second type, each one of which comprising a second combination of one or more light emitting elements in one or more of said first, said second and said third colour; and a driving element for driving said light-emitting clusters; wherein, when driven at the output intensity, the spectral output is provided by a combined spectral output of said one or more light-emitting clusters of said first type and said one or more light-emitting clusters of said second type.

In accordance with another aspect of the present invention, there is provided a light source for producing a spectral output at an output intensity, the light source comprising: one or more light-emitting clusters of each of a first type and of one or more other types; and a driving element for driving said one or more light-emitting clusters of said first type and of said one or more other types; each cluster of said first type comprising one or more light-emitting elements in each of at least a first, a second and a third colour having respective output efficiencies, wherein one or more of said respective output efficiencies are lower than one or more others of said respective output efficiencies; and each cluster of said one or more other types comprising one or more light-emitting elements selected to compensate for said one or more lower respective output efficiencies such that when driven to provide the output intensity, a spectral output of said one or more light-emitting clusters of said first type is substantially balanced by a spectral output of said one or more light-emitting clusters of said one or more other types.

DETAILED DESCRIPTION OF THE INVENTION

Definitions

Figure 1:
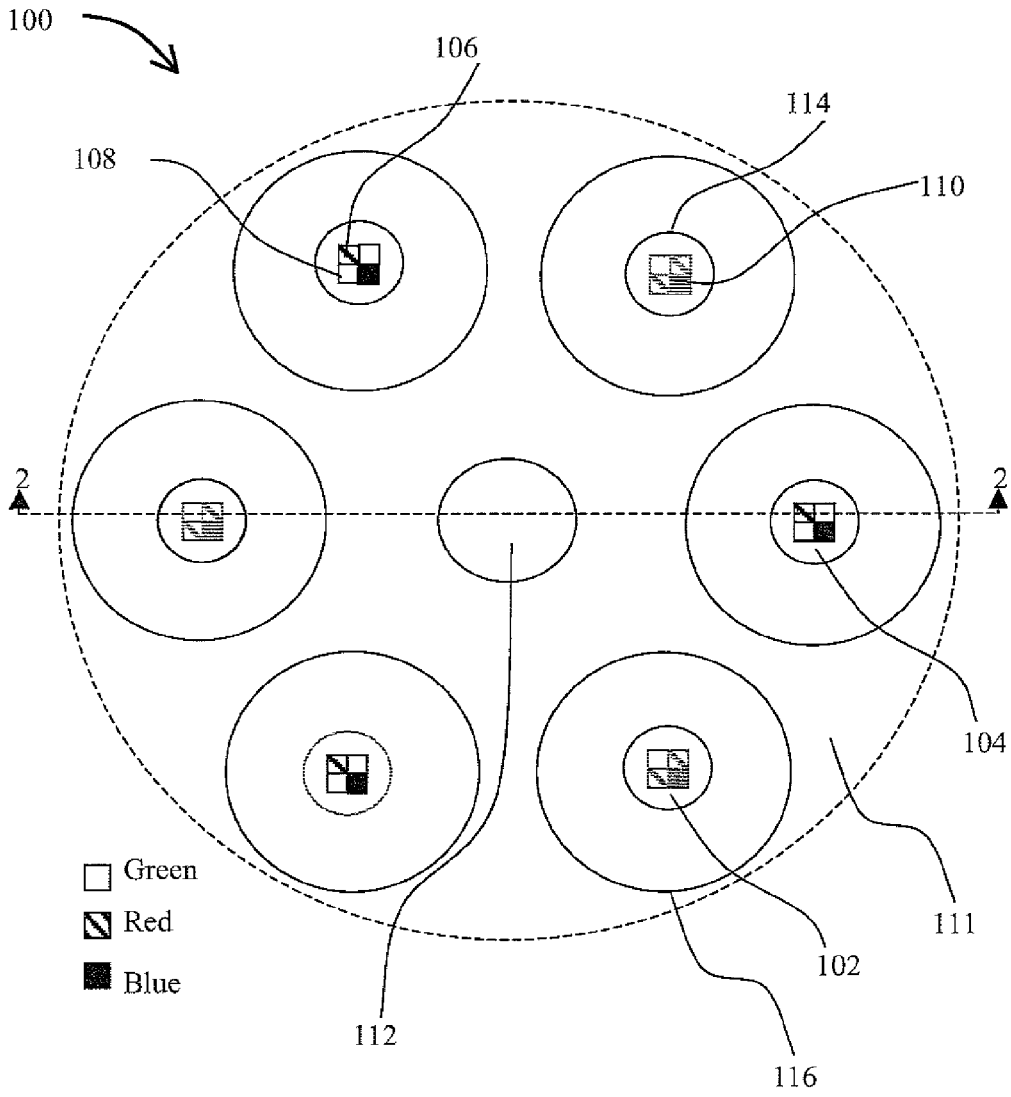
FIG. 1 is a diagrammatical top plan view of a light source comprising light-emitting clusters, in accordance with an embodiment of the present invention.

The term "light-emitting element" is used to define a device that emits radiation in a region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or other similar devices as would be readily understood by a worker skilled in the art. Furthermore, the term light-emitting element is used to define the specific device that emits the radiation, for example a LED die, chip or other such device as will be readily understood by the person of skill in the art, and can equally be used to define a combination of the specific device that emits the radiation together with a dedicated or shared substrate, driving and/or optical output means of the specific device(s), or a housing or package within which the specific device or devices are placed.

The terms "spectral power distribution" and "spectral output" are used interchangeably to define the overall general spectral output of a light source, of a light-emitting element cluster thereof, and/or of the light-emitting element(s) thereof. In general, these terms are used to define a spectral content of the light emitted by the light source/light-emitting element cluster/light-emitting element(s).

The term "colour" is used to define the overall general output of a light source, of a light-emitting element cluster thereof, and/or of the light-emitting element(s) thereof, as perceived by a human subject. Each colour is usually associated with a given peak wavelength or range of wavelengths in a given region of the visible or near-visible spectrum, for example, between and including ultraviolet to infrared, but may also be used to describe a combination of such wavelengths within a combined spectral power distribution (spectral output) generally perceived and identified as a resultant colour of the spectral combination.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a light source for producing a substantially balanced spectral output at a substantially optimised output intensity. For instance, in one embodiment, the light source comprises two or more light-emitting clusters, each comprising one or more light-emitting elements, such that, when all light-emitting elements are driven at a substantially optimised output intensity, the spectral output of the first light-emitting cluster is substantially balanced by the spectral output of the one or more other light-emitting clusters, thereby producing a substantially balanced spectral output from the light source.

In a light source comprising one or more identical clusters of light-emitting elements, for example comprising one or more light-emitting element packages each comprising a same combination of light-emitting element colours (e.g. red, green and blue light-emitting elements, red, green, amber and blue light-emitting elements, etc.), when all the light-emitting elements within a given cluster are driven to their respective maximum intensity, the combined light output does not generally correspond to a desired combined spectral output, such as for example the white point at the centre of the CIE 1931 colour space chromaticity diagram. This often results from the fact that differently coloured light-emitting elements generally have different output intensities and efficiencies. As such, the range of colours in these light sources for which maximum light output is achievable is generally biased to one or more of the constituent LED colours in the package(s) or cluster(s), generally the light-emitting element colour(s) having a higher output efficiency and/or capacity.

Consequently, it is generally difficult to select a minimal number of light-emitting elements (e.g. three light-emitting elements in an RGB cluster or four light-emitting elements in an RAGB cluster) to minimise manufacturing costs while having each light-emitting element operate at an optimal output intensity such that a combined maximum output thereof is substantially centred at the white point of the CIE 1931 colour space chromaticity diagram, or around other such desirable combined outputs. For instance, this situation may also apply when designing light sources for which an optimal output intensity at a given colour, or within a given colour range, is desired.

Accordingly, to achieve a desired spectral output using one or more identical light-emitting clusters each comprising one each of a red, a green and a blue light-emitting element, for example, the relative power with which each constituent light-emitting element is driven must be adjusted to overcome differences in the output efficiency of differently coloured light-emitting elements. This thus yields significant intensity losses relative to a maximum light source output intensity available only when each light-emitting element is driven at about or near its maximum output intensity.

The light source of the present invention, however, reduces such losses in potential output intensity using different combinations of clustered light-emitting elements, and in some embodiments, using different combinations of such light-emitting clusters. For instance, the substantially balanced spectral output of the light source is generally achieved by a combination of the respective spectral outputs of the light source's various light-emitting elements, which are themselves generally configured in a number of light-emitting clusters. For example, the light source may comprise one or more clusters in each of two or more types, which may be generally defined by respective and generally distinct combinations of light-emitting elements.

As will be described in greater detail below, and with reference to the examples depicted in FIGS. 1 to 7, by proper selection of a combination of light-emitting elements to be used within each type of light-emitting cluster, and possibly, by selecting an appropriate number of light-emitting clusters of each type, a substantially balanced spectral output may be achieved even when driving the light-emitting clusters, and the light-emitting elements thereof, at or near a substantially optimised output intensity. Furthermore, by carefully selecting the light-emitting elements for each cluster type, as discussed below, the number of different types may be minimised so to reduce manufacturing costs associated with the production of plural types of light-emitting clusters. Also, using this approach, little or no control as to the relative drive current or signal provided to respective clusters and/or light-emitting elements may be required to achieve the desired substantially balanced spectral output as a significant adjustment of the relative outputs of different coloured light-emitting elements is directly addressed by the selection of their numbers and combinations within the selected types of light-emitting clusters.

As will be discussed further below, in one embodiment, however, a control element is also provided to further improve the spectral output of the light source, for example, providing a fine tuning thereof without significant loss to a potential maximum output intensity available from the light-emitting elements used. A feedback system, comprising for example, a sensing element operatively coupled to such a control element, may also be considered in the present context, to monitor an output of the light source and provide a feedback-driven control thereof to maintain the output within a predetermined range or tolerance from a desired output, for example.

Substantially Balanced Light Source Spectral Output

The substantially balanced spectral output may be considered to comprise various optical and/or spectral outputs achievable by the combination of the respective outputs of the light source's light-emitting clusters and elements thereof. For instance, a substantially balanced output may include, but is not limited to, a white or coloured light of a given colour temperature, chromaticity, colour rendering index, colour quality and/or of other such spectral, colour and/or colour rendering characteristics readily understood by the person skilled in the art.

In one embodiment, for example, the light source is configured to provide a balanced output substantially centred on the white point of the CIE 1931 colour space chromaticity diagram. In another embodiment, the light source is configured to achieve a given colour quality and/or colour rendering index via the substantial balance of the respective spectral outputs of the light source's light-emitting clusters. Other such substantially balanced outputs should be apparent to the person of skill in the art and are thus not considered to depart from the general scope and nature of the present disclosure.

Furthermore, it will be appreciated that a balanced output may be achieved to various degrees within a given range of acceptable outputs, possibly defined within the context, or by a given application for which the light source is to be used. For example, a light source may be designed such that, when the light-emitting clusters thereof are operated to provide a substantially optimal output intensity, the spectral output of the light source will provide an appropriately balanced output for the application at hand. Such degree of balance or tolerance may be defined for example, to fall within a percentage variation from a reasonably achievable optimal value, or again from a threshold value below which the light source may not be deemed adequate for the application at hand. Output specifications for a given light source, and acceptable variation therefrom acceptable for the application for which the light source is to be used, vary from application to application, and should be apparent to the person of skill in the art.

The person of skill in the art will readily understand that other considerations may be accounted for in determining and defining the substantially balanced output desired for a given light source, and application for which it is to be used, without departing from the general scope and nature of the present disclosure. Such considerations may include, but are not limited to, spectral and/or operational limitations of certain types of light-emitting elements, light-emitting element materials, and/or optical components used in the fabrication of a given light source, the variation and/or fluctuation in the output characteristics of such components over time due to ageing, varying operating characteristics and/or environmental conditions (e.g. intensity fluctuations, spectral shifts and/or broadening, degradation of the optical components, etc.) and other such effects possibly induced by the light-emitting elements, for example, at high output intensities.

Substantially Optimal Light Source Output Intensity

The substantially optimised output intensity of the light source is generally attributed to the output intensity of the light source provided when each light-emitting element thereof is driven to emit light at about or near a respective optimal output intensity. In general, a light source operating at about or near a substantially optimised output intensity makes full use of each light-emitting element, that is, uses each light-emitting element at about or near its full output potential.

In one embodiment, each light-emitting element is operated at an optimal output intensity limited only by an available drive current for driving each light-emitting element and an output efficiency of each said light-emitting element, the latter of which depending mostly on the respective output colour/spectrum of each light-emitting element. In this embodiment, the substantially optimal output intensity may thus be defined as the maximum output intensity achievable by the selected light-emitting elements within each light-emitting cluster.

In another embodiment, the output intensity of each light-emitting element is adjusted relative to a maximum available output intensity to fine tune a colour mixing, and thereby a spectral output of the light source in order to further achieve a balanced output. For example, one or more light-emitting clusters may be selected such that a substantially balanced output is provided within a first tolerance of an ideal output when driven at about or near a maximum output intensity, and wherein a further tuning of the light-emitting elements of the one or more light-emitting clusters may achieve a further substantially balanced output which is within a second, and generally more restrictive tolerance of the ideal output. The output intensity sacrificed in order to achieve an output within the second tolerance could be sufficiently small relative to the total output intensity to justify the tuning of light-emitting element intensities. Consequently, the optimal output intensity could be defined as the maximum output intensity achievable by the selected light-emitting clusters, which yields a substantially balanced output within the first tolerance, or defined as the adjusted output intensities of the various light-emitting elements and/or clusters selected to achieve an output within the second tolerance. As an example, in one embodiment, the intensity of each cluster may vary within a range of about +/−15-20% while maintaining a substantially optimal output intensity. Larger and smaller ranges may also be considered depending, for example, on the number of clusters being used, the tolerance on the output quality desired for a given application, and other such factors as will be readily apparent to the person skilled in the art.

The person of skill in the art will readily understand that other considerations may be accounted for in determining the optimal output intensity of a given light source, and its various light-emitting clusters and/or elements thereof, without departing from the general scope and nature of the present disclosure. Such considerations may include, but are not limited to mechanical effects, optical output instabilities and/or variations (e.g. intensity fluctuations, spectral shifts and/or broadening, degradation of the optical components, etc.) and other such effects possibly induced by the light-emitting elements, for example, at high output intensities.

Light Source

The light source generally comprises two or more light-emitting clusters each comprising one or more light-emitting elements. In general, the one or more light-emitting elements of each cluster are configured to emit light toward an output of the light source, which may comprise one or more of a transparent window, a lens for directing the light source output, a filter for selecting a spectral component of the output, a diffuser for further mixing and combining the respective cluster outputs, and the like. In addition, in one embodiment, each light-emitting cluster comprises a primary output optics such as a reflector, a lens, or the like. In another embodiment, each cluster further comprises a secondary optics for further combining and mixing the cluster's output.

In general, the light source is further configured to be driven by a driving element, which may include, but is not limited to, a driving module, a driving/control module, driving circuitry, hardware and/or software, and/or other such driving means, that allow for driving the light source to provide a substantially optimal output intensity while substantially maintaining a balanced output. For instance, the driving element may comprise one or more printed circuit boards (PCB) or the like configured to drive the light-emitting elements of each cluster. For example, each cluster may be mounted to a respective or shared substrate and PCB.

Thermal management systems known in the art, such as one or more heatsinks, active or passive cooling systems, and the like, may also be considered in the present context, as will be readily understood by the person of skill in the art.

Furthermore, an optional control element, which may include, but is not limited to, a micro-controller, a hardware, firmware and/or software platform, control circuitry and/or other such control means and/or modules, may also be operatively coupled to, or integrally provided as part of the driving element, to drive the light-emitting elements of the light-source's clusters with increased control, thereby providing increased control over the light-source's output.

In one embodiment, the light source comprises a control/driving element configured to provide a substantially same drive current to each light-emitting cluster and to each light-emitting element comprised therein. By proper selection of each cluster's light-emitting elements, namely as a function of each light-emitting element's relative output efficiency, a substantially balanced light source output may be achieved at a substantially optimal output intensity. For example, in an embodiment where a balanced output is defined by providing a substantially equal output from each of two or more colours of light-emitting elements, by selecting the ratio of the number of light-emitting elements of a colour exhibiting a lower efficiency to the number of light-emitting elements of a colour exhibiting a higher efficiency to be substantially equal to the ratio of the higher and lower efficiencies, the substantially balanced output may be achieved.

In a similar embodiment where the balanced output is defined by having each colour of light-emitting element provide a pre-selected contribution to the overall spectral output of the light source, for example to provide a light source spectral output selected to have a predefined spectral content that may be skewed toward a given region of the visible spectrum, the ratio of the number of light-emitting elements of each colour provided by the different types of clusters (e.g. clusters having different numbers of light-emitting elements of same or different colours), may be selected to account for both the desired light source output and the respective output efficiency of each colour of light-emitting element used. Namely, the ratio of the number of light-emitting elements of a first colour having a lower output efficiency to the number of light-emitting elements of another colour having a higher efficiency may be selected as a function of both the respective efficiencies of these light-emitting elements (as above) and the ratio of respective spectral contributions of these light-emitting elements required to balance the light source's spectral output.

In another embodiment, the light source comprises a control/driving element configured to provide independent intensity control for each type of cluster. For instance, a cluster of a first type comprising a first set of one or more light-emitting elements may be driven at a different intensity than a cluster of another type comprising another set of one or more light-emitting elements. As such, though a substantially balanced output may be achieved at maximum power within a first tolerance relative to an ideal balanced output, as introduced above, a relative tuning of the output intensities of the light source's various light-emitting cluster types may be used to achieve an increased balance, namely a substantially balanced output located within a second, more restrictive tolerance relative to the ideal balanced output. Such tuning, which may comprise a fine or a relatively coarse tuning of output intensities, may yield a redefined substantially optimal output intensity that accounts for an acceptable loss in output intensity considering the achieved gain in the refinement of the light source's spectral output balance.

In yet another embodiment, the light source comprises a control/driving element configured to provide independent intensity control for each light-emitting element of each light-emitting cluster. As will be understood by the person skilled in the art, likewise as described in relation to the previous embodiment, such refined intensity control may allow for an even finer tuning of the light-source's spectral output, thereby providing an even greater balanced output while providing a substantially optimal output intensity within an acceptable intensity margin relative to an uppermost output intensity achievable when maximum current is applied to each light-emitting element.

The light source may further optionally comprise a sensing element, comprising for example one or more sensors such as a photodetector or other such sensing means, for sensing a portion of the light emitted by the clusters and converting this light into an electrical signal representative of the light emitted by the clusters. Examples of sensing elements may comprise various types of optical sensors, such as semiconductor photodiodes, photosensors, LEDs or other optical sensors as would be readily understood by a worker skilled in the art, configured to detect light within one or more frequency ranges.

In one embodiment, the clusters may be arranged such that a portion of the light emitted from each cluster is directed to a sensing element such that an output of the light source may be monitored, namely via an optional monitoring means operatively coupled to the sensing means. For example, the clusters may be substantially symmetrically disposed about a single sensor such that substantially equal portions of light emitted by the various clusters are incident thereon, or again a combination of sensors may be used co-operatively for respective clusters. Various example cluster-sensor configurations are illustrated in the appended drawings. Other such configurations should be apparent to the person of skill in the art and are thus not meant to depart from the general scope and nature of the present disclosure.

In general, the optional sensing and monitoring element (s) may be configured to assess the output of the light source, and of its various light-emitting clusters, in order to monitor an individual and/or combined intensity, and/or spectral output thereof. By operatively coupling such sensing and monitoring means to an optional light source control element, as discussed above, the output of the light source may be monitored and adjusted such that a substantially constant output is maintained. For example, in an embodiment where control of the output of a first type of light-emitting cluster is adjustable relative to an output of another type, the output of the light source, and in particular the spectral balance thereof, may be maintained substantially constant despite natural fluctuations in the output of the light source's light-emitting clusters and/or light-emitting elements. For instance, output fluctuations due to one or more of ageing, and other such mechanical and/or electrical effects as would be readily understood by the person skilled in the art, could be adjusted for in this embodiment by the operational co-operation of the optional sensing, monitoring, control and driving elements.

As will be understood by the person of skill in the art, various combinations of optional sensing, monitoring, control and driving means may be considered in the present context without departing from the general scope and nature of the present disclosure. For instance, a dedicated light collection element (e.g. a reflective element) may be included to redirect a portion of the light emitted by the light-emitting clusters to the one or more sensing elements, or light may be directed to the sensing element directly or indirectly by different types of guided and/or reflected outputs (e.g. light guide, internal reflection from a light source output optics, etc.).

Light-Emitting Clusters

Numerous arrangements of the light-emitting elements within each light-emitting cluster are possible to achieve the results taught by the present disclosure, as are numerous arrangements of the light-emitting clusters within the light source. In general, clusters contemplated in the present disclosure comprise one or more light-emitting elements, in one of a variety of combinations, when such a combination is conducive to achieving a substantially balanced light source output at a substantially optimal light source output intensity.

In accordance with one embodiment of the present invention, a light-emitting cluster comprises one or more light-emitting elements in one or more colours. For example, a light-emitting cluster may comprise one or more light-emitting elements of a single colour and/or peak wavelength (e.g. all red (R), amber (A), green (G), blue (B), etc.), or light emitting elements of different colours and/or wavelengths, and possibly in different combinations (e.g. RGB, RRGB, $R_1R_2GB$, AGBB, etc.—wherein subscripts identify different peak wavelengths for light-emitting elements emitting within similar colour ranges). Also, different types of light-emitting elements (e.g. semiconductor, organic, or polymer/polymeric light-emitting diodes, optically pumped phosphor coated light-emitting diodes, optically pumped nano-crystal light-emitting diodes, etc.) and light-emitting elements of different sizes may also be combined within a same cluster.

In one embodiment, each light-emitting element of a given cluster is combined and manufactured within a single housing or package. For instance, a package may be manufactured to combine a cluster of light-emitting elements, which may all be of a same colour, of different colours, or in different combinations thereof. For example, a single packaged cluster could comprise one or more light-emitting elements, and optionally one or more of a dedicated output optics, heat management system, driving element and other components readily used and known by the person skilled in the art to manufacture a light-emitting element package. Such cluster packages could be pre-assembled and/or manufactured for quick and easy assembly in a given light source configuration. Use of such packaged clusters may also simplify, in certain embodiments, light-emitting element optics and electrical power connections to the clusters. As will be understood by the person skilled in the art, various combinations of clusters and packaged clusters may be considered without departing from the scope and nature of the present disclosure.

In one embodiment, each cluster comprises four light-emitting elements, wherein a light-emitting element of a given colour having a lower relative efficiency is doubled as to compensate for this reduced relative efficiency and thereby improve an output colour balance of the cluster. Examples of such clusters could include, but are not limited to, an RRGB cluster, an RGGB cluster or an RGBB cluster. Note that currently available blue light-emitting elements generally provide higher outputs than their counterpart red or green light-emitting elements such that an RRGB or an RGGB option may be more appropriate with current technologies than an RGBB option, particularly when the spectral output of the light source is to be balanced to provide a substantially white or coloured output whose blue component is not to overshadow that of the red, green, amber or other such light-emitting element. With further advances in light-emitting element technology, however, red or green light-emitting elements may become more efficient than their blue counterparts, rendering an RGBB solution useful in that situation. In addition, when considering a light-emitting cluster configured within a single light-emitting package, a four light-emitting element configuration may be closely packed to make a most efficient use of the space within such a package while providing a greater output intensity than a package comprising only three light-emitting elements.

In one embodiment, each cluster comprises the same four light-emitting elements. Such an embodiment may provide a substantially balanced output at a substantially optimal output intensity, for example, when the balanced output is defined by a substantially equal spectral contribution from each light-emitting element colour and when one considers a combination of three different colours of light-emitting elements (e.g. red, green and blue) whose respective output efficiencies and/or optimal output intensities are substantially defined by a 1:2:2 ratio. That is, when the efficiency of a light-emitting element of a given colour is about half that of a light-emitting element of either of the two other colours, the above solution may provide a significant advantage over a traditional RGB cluster. Efficiency ratios, however, are not commonly so defined. For instance, using current light-emitting element technology, while the contribution of the most efficient blue light is proportionally lower than in a three light-emitting element RGB cluster, in a light source exclusively comprising RRGB clusters, a highest output would likely be achieved in areas of the spectrum biased in the red, whereas in a light source exclusively comprising RGGB clusters, a highest output would likely be biased in the green.

In another embodiment, two or more types of clusters are used to provide a desired colour balance, each cluster comprising one or more light-emitting elements. In general, at least one of the clusters will comprise three or four light-emitting elements, whereas other clusters may comprise different numbers of light-emitting elements needed to provide the desired spectral balance. In one embodiment, the selection of light-emitting elements, and their respective numbers, is based on the respective efficiencies, and consequently respective optimal output intensities, of these light-emitting elements.

For example, based on the performance specifications of a given set of currently available mass produced RGB light emitting elements, a colour ratio of 3R:3G:2B may be chosen to provide a suitable colour balance under optimal output conditions, namely when the light source is designed to provide a relatively balanced white light output. To achieve this ratio, in one embodiment, the light source could comprise an equal number of two different types of clusters, namely RRGB and RGGB clusters. For example, a given light source could comprise one, two, three or more of each type. Alternatively, a light source could comprise one RG cluster for each two RGB cluster.

As the performance of mass manufactured light-emitting elements improves, the ratio of light-emitting elements in each cluster may be changed accordingly. For example, the clusters of the above example may be replaced by RGBB and RGGB clusters in the event that the general efficiency of red light-emitting elements surpasses that of green and blue light-emitting elements. Other such variations should be apparent to the person of skill in the art and are thus not meant to depart from the general scope and nature of the present disclosure.

Alternatively, the light source may comprise a combination of clusters each containing three light-emitting elements only. For example, a light source could comprise a combination of ROB and AGB clusters such that an output of the amber light-emitting elements balances an output of the red light-emitting elements relative to the green and blue light-emitting elements.

In another embodiment, single colour clusters are combined with multicolour clusters. For instance, when using a colour having an efficiency significantly lower than that of one or more other colours, a first cluster could comprise three different colour light-emitting elements while a second cluster could comprise three same colour light-emitting elements. Such a configuration could then yield a 4:1:1 ratio suitable to compensate for a substantially lower relative output of a given light-emitting element.

In another embodiment, the light source may comprise a combination of three light-emitting element clusters and four light-emitting element clusters. One such example could include a combination of equal numbers of RGB and RGGB clusters, thereby providing a 2:3:2 light-emitting element ratio. Unequal numbers of such clusters could also be considered to achieve other ratios.

In another embodiment, the light source may comprise a combination of clusters such as $R_1G_1G_2B$ and $R_1R_2G_1B$ clusters, wherein the subscripts indicate different peak wavelengths of either red or green light-emitting elements. Further, the blue LEDs may also be of different wavelengths.

As presented above, the light-emitting clusters may also comprise light-emitting elements of different sizes such that a light-emitting element having a lower output efficiency may be selected to be larger than one having a higher output efficiency. As a result, the output balance of such a cluster may be increased as the output of the weaker light-emitting element is at least partially compensated for by its size. In one embodiment, the compensation provided by the differently sized light-emitting elements is sufficient to provide the substantially balanced output desired for the application for which the light source is designed. In another embodiment, the light source comprises one or more clusters of a first type having differently sized light-emitting elements, and one or more other types of clusters, each optionally comprising differently sized light-emitting elements, such that a combined output of the light source is substantially balanced by the combination of cluster outputs. The person of skill in the art will understand that other such combinations of clusters having differently sized light-emitting elements may be considered without departing from the general scope and nature of the present disclosure.

The person of skill in the art will also readily understand that the light-emitting elements within the clusters may emit various colours other than red, green and blue. For example, clusters may contain amber or cyan light-emitting elements, phosphor coated light-emitting elements, or other types of current or future light-emitting elements.

Also, as will be readily understood, numerous arrangements of the light-emitting clusters are possible. They could be arranged in a rectangular or square array, or in two or more concentric circles, or perhaps in two different planes. One or more linear arrays could also be used.

The number of clusters may also be varied depending on the selected configuration, the intended ratio of the various light-emitting elements contained therein, and/or the total output intensity required for a given application. Furthermore, in some cases, it may be beneficial to have an odd number of clusters thereby allowing for an increased colour balancing of the light source output.

The invention will now be described with reference to specific examples. It will be understood that the following examples are intended to describe embodiments of the invention and are not intended to limit the invention in any way.

EXAMPLES

Example 1

Figure 2:
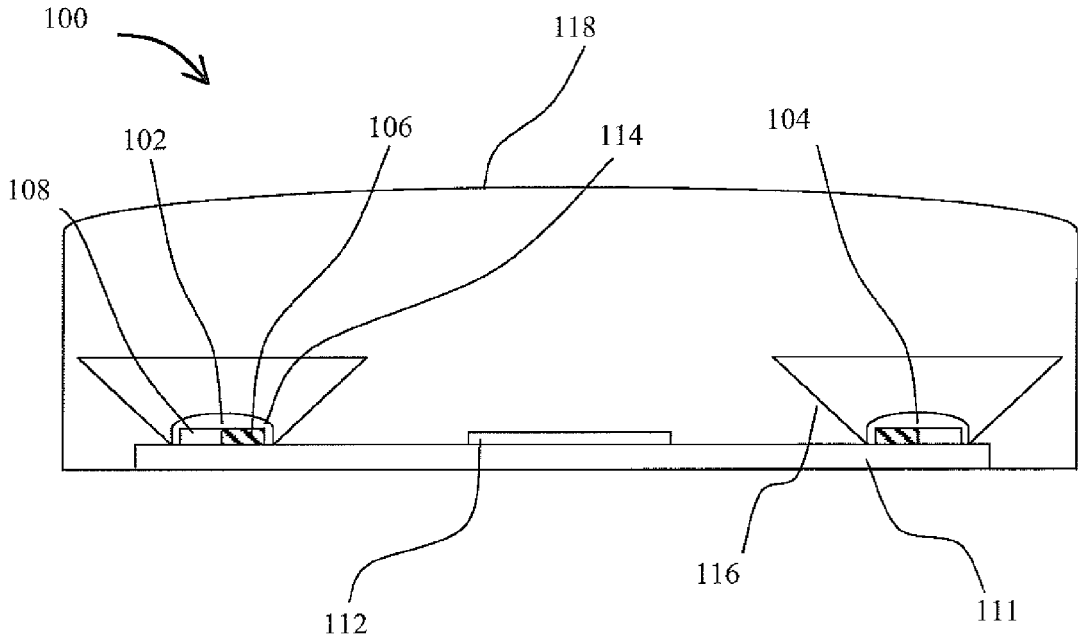
FIG. 2 is a cross sectional view of the light source of FIG. 1 taken along line 2-2 thereof.

Referring now to FIGS. 1 and 2, a light source, generally referred to using the numeral 100 and in accordance with an embodiment of the present invention, will now be described. The light source 100 generally comprises six light-emitting clusters, three each of a first type of cluster, as in cluster 102, and of a second type of cluster, as in cluster 104. Light-emitting clusters 102 and 104 are each comprised of red, green and blue light-emitting elements, as in elements 106, 108 and 110, respectively, wherein in this particular embodiment an output intensity (or output efficiency) of the blue light-emitting elements 110 is about 1.5 times higher than that of the red and green light-emitting elements 106 and 108, respectively. As such, to provide a substantially balanced output, defined by a substantially equal contribution by each colour of light-emitting element, at a substantially optimal output intensity, each cluster 102 comprises two red light-emitting elements 106, one green light-emitting element 108 and one blue light-emitting element 110, while each cluster 104 comprises one red light-emitting element 106, two green light-emitting elements 108 and one blue light-emitting element 110, resulting in a R:G:B ratio of about 3:3:2.

In general, the light-emitting clusters 102 and 104 are mounted on a substrate 111 together with respective and/or shared driving elements (not shown). The light-emitting clusters 102 and 104 also generally comprise respective and/or shared thermal management systems, also commonly known in the art, to dissipate heat from the light-emitting clusters 102 and 104 and respective light-emitting elements 106, 108 and 110 thereof.

As illustrated in FIG. 1, the clusters 102 and 104 are arranged in alternation in a circular design around an optional optical sensor 112 positioned on the centre axis of the light source 100 so to both collect and detect the light emitted from the clusters 102 and 104. An optional control element (not shown), such as a microcontroller or other such control means readily known in the art, may be operatively coupled between the driving element and the sensor 112 and used to adjust the respective output intensity of the clusters 102 and 104, and optionally of their respective light-emitting elements 106, 108 and 110, to thereby adjust and substantially maintain an output colour balance of the light source 100. Such control means may also be used to adjust and substantially maintain the light source's output intensity.

Each cluster 102 and 104 may also optionally comprise primary and secondary output optics 114 and 116, respectively, for directing light emitted thereby to a light source output 118, which may comprise a window, a lens, a diffuser, one or more filters and/or other such optical elements readily known to the person skilled in the art. The desired colour balance, though possibly not achieved in the near field where light from all the clusters 102 and 104 may not completely overlap, will generally be achieved once light is adequately mixed by one or more of the optional primary optics 114, secondary optics 116 and/or light source output 118 (e.g. in the far field). The person of skill in the art will readily understand that various output optics may be considered in the present example. Namely, various optical elements integral or external to the various light-emitting clusters 102 and 104 may be considered to provide similar results, and as such, should not be considered to be outside the intended scope of the present disclosure.

Example 2

Figure 3:
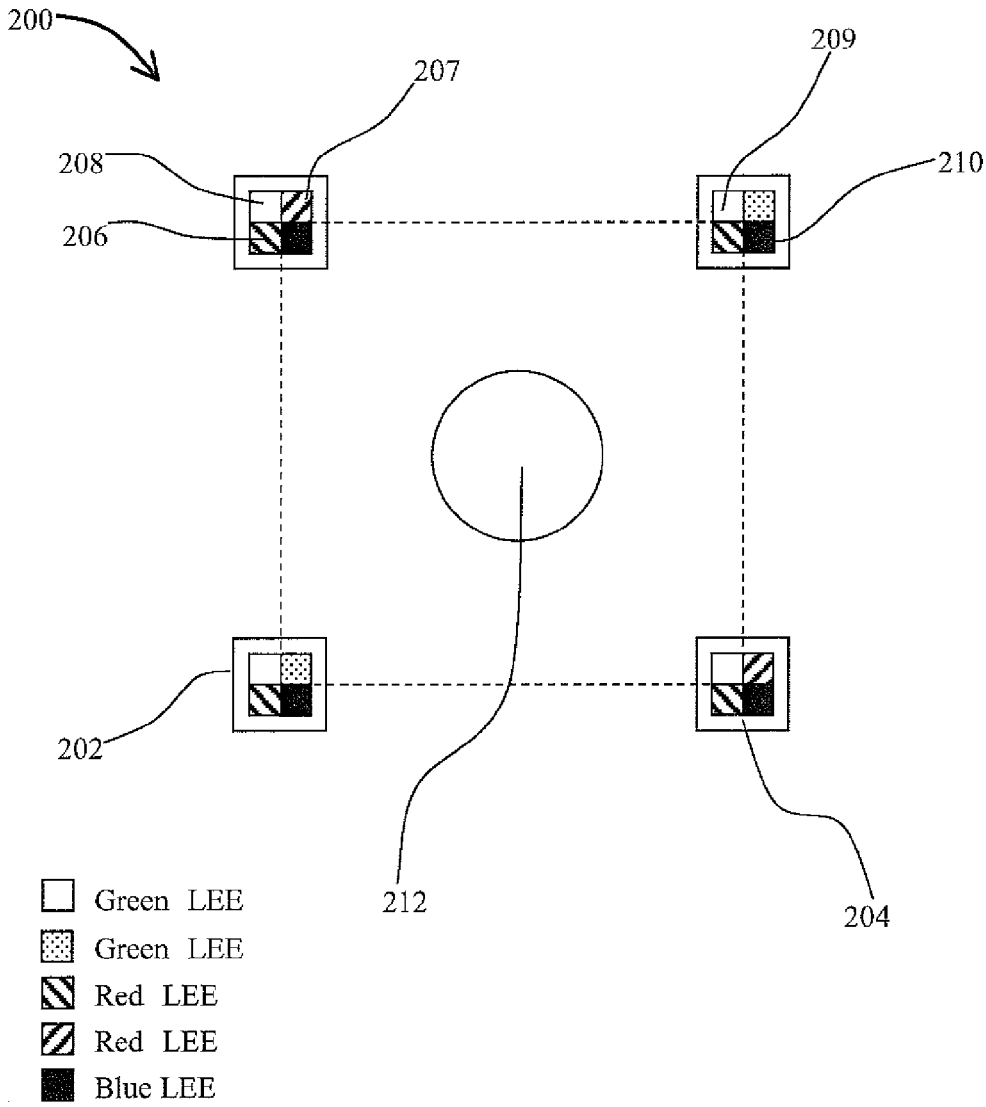
FIG. 3 is a diagrammatical top plan view of a light source comprising light-emitting clusters, in accordance with another embodiment of the present invention.

Referring now to FIG. 3, a light source, generally referred to using the numeral 200 and in accordance with an embodiment of the present invention, will now be described. The light source 200 generally comprises four light-emitting clusters, two each of a first type of cluster, as in cluster 202, and of a second type of cluster, as in cluster 204. Light-emitting clusters 202 each comprise one red light-emitting element, as in element 206 defined by a first peak wavelength $R_1$, two green light-emitting elements, as in elements 208 and 209 respectively defined by different peak output wavelengths $G_1$ and $G_2$, and one blue light-emitting element, as in element 210. Light-emitting clusters 204 each comprise two red light-emitting elements, as in elements 206 and 207 respectively defined by different peak output wavelengths $R_1$ and $R_2$, one green light-emitting element 208, and one blue light-emitting element 210. The combination of clusters 202 and 204 can thus be expressed as $R_1G_1G_2B+R_1R_2G_1B$, wherein not only are emissions from lower efficiency red and green light-emitting elements substantially balanced by an increased representation of such light-emitting elements in the combined cluster types, but an improved combined spectral output may also be achieved by providing red and green light-emitting elements each having different peak output wavelengths. This embodiment thus provides for a substantially balanced output, in this example again defined by a substantially equal spectral contribution from each colour, when an output intensity (or output efficiency) of the blue light-emitting elements 210 is about 1.5 times higher than that of the red and green light-emitting elements 206, 207 and 208, 209, respectively, but when directly addressing this efficiency difference, as in Example 1, does not provide a sufficiently balanced output, namely within a desired and/or required tolerance for the application for which the light source is designed. In particular, this embodiment allows to further refine the colour balance at the substantially optimal output intensity.

It will be appreciated by the person of skill in the art that a similar light source may also be used, for example, when a desired balanced output of the light source is defined by a spectral power distribution exhibiting a dip in the blue region of the spectrum if light-emitting elements are used which have substantially equal output efficiencies. Other such balanced outputs may also be considered within the present context, when considering light-emitting elements having different relative efficiencies.

Other considerations discussed in relation to the design and manufacture of the light source 100 of Example 1 may also apply to light source 200, as will be readily understood by the person skilled in the art. For instance, the light-emitting clusters 202 and 204 may be mounted on a substrate via respective and/or shared driving elements and comprise respective and/or shared thermal management systems to dissipate heat from the light-emitting clusters 202 and 204 and respective light-emitting elements 206, 207, 208, 209 and 210 thereof. In this example, however, the clusters 202 and 204 are arranged in alternation in a square or rectangular design around an optional optical sensor 212 positioned on the centre axis of the light source 200 so to both collect and detect the light emitted from the clusters 202 and 204. An optional control element may again be used to adjust the respective output intensities of the clusters 202 and 204, and optionally of their respective light-emitting elements 206, 207, 208, 209 and 210, to thereby adjust and substantially maintain an output colour balance and/or output intensity of the light source 200.

Each cluster 202 and 204 may also optionally comprise primary optics, and optionally secondary optics, for directing light emitted thereby to the light source output, which may again comprise a window, a lens, a diffuser, one or more filters and the like. The person of skill in the art will again readily understand that various output optics may be considered in the present example, whether they be integral or external to the various light-emitting clusters 202 and 204, to provide similar results, and as such, should not be considered to be outside the intended scope of the present disclosure.

Example 3

Figure 4:
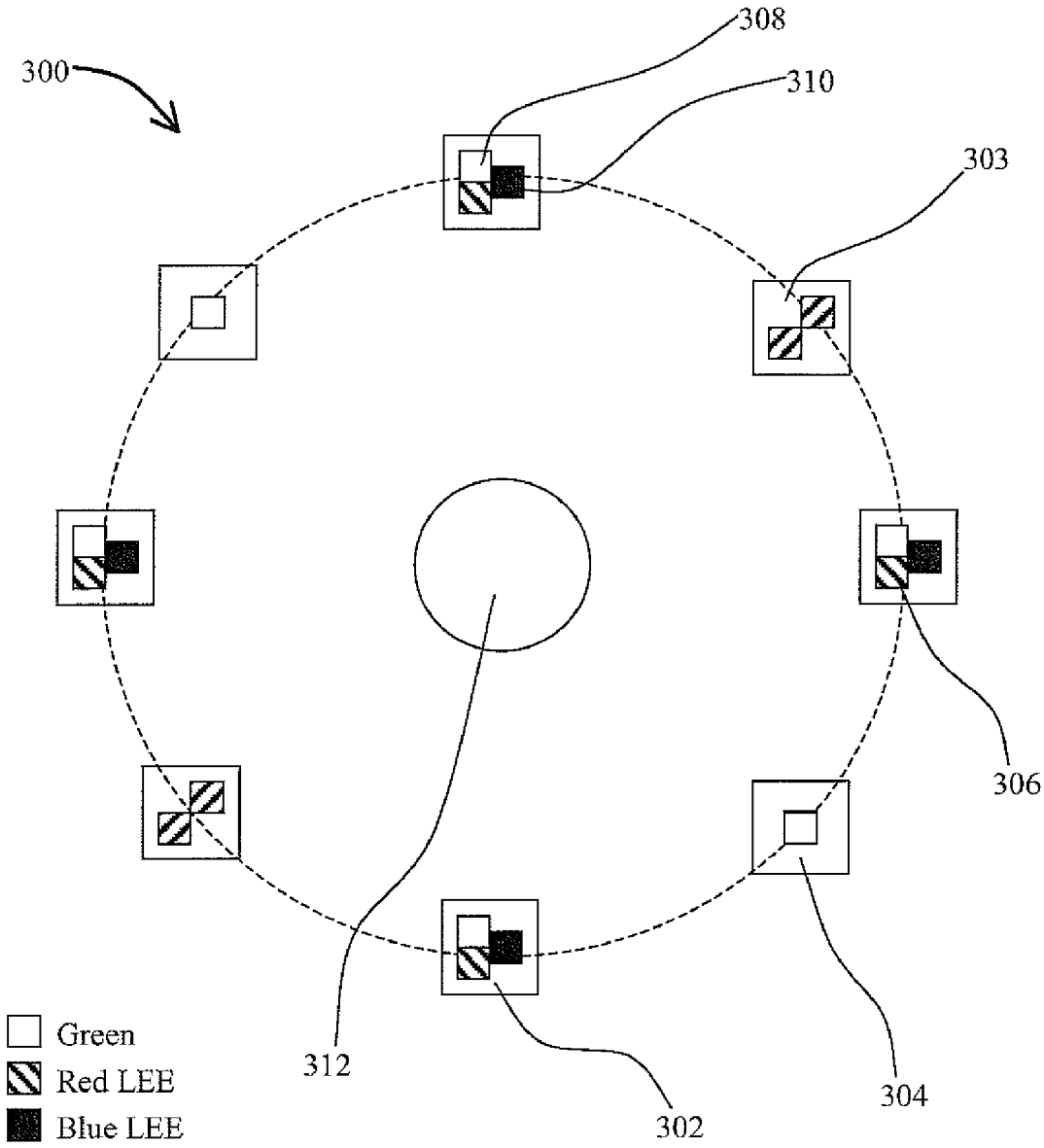
FIG. 4 is a diagrammatical top plan view of a light source comprising light-emitting clusters, in accordance with another embodiment of the present invention.

Referring now to FIG. 4, a light source, generally referred to using the numeral 300 and in accordance with an embodiment of the present invention, will now be described. The light source 300 generally comprises eight light-emitting clusters, four of a first type of cluster, as in cluster 302, and two each of a second type of cluster, as in cluster 303, and of a third type of cluster, as in cluster 304. Light-emitting clusters 302, 303 and 304 are each comprised of one or more red, green and/or blue light-emitting elements, as in elements 306, 308 and 310 respectively, wherein in this particular embodiment an output intensity (or output efficiency) of the blue light-emitting elements 310 is about 2 times higher than that of the red light-emitting elements 306 and about 1.5 times higher than that of the green light-emitting elements 308. As such, to provide a substantially balanced output, again defined by providing a substantially equal spectral contribution in each colour, at a substantially optimal output intensity, light-emitting clusters 302 each comprise one red light-emitting element 306, one green light-emitting element 308, and one blue light-emitting element 310; light-emitting clusters 303 each comprise two red light-emitting elements 306; and light-emitting clusters 304 each comprise one green light-emitting element 308, resulting in a R:G:B ratio of about 4:3:2.

It will be appreciated by the person of skill in the art that a similar light source may also be used, for example, when a desired balanced output of the light source is defined by a spectral power distribution skewed toward a particular region of the visible spectrum if light-emitting elements are used which have correspondingly different relative output efficiencies.

Other considerations discussed in relation to the design and manufacture of the light source 100 of Example 1 may also apply to light source 300, as will be readily understood by the person skilled in the art. For instance, the light-emitting clusters 302, 303 and 304 may be mounted on a substrate together with respective and/or shared driving means and comprise respective and/or shared thermal management systems to dissipate heat from the light-emitting clusters 302, 303 and 304 and respective light-emitting elements 306, 308 and 310 thereof. In this example, the clusters 302, 303 and 304 are arranged in a circular design around an optional optical sensor 312 positioned on the centre axis of the light source 300 so to both collect and detect the light emitted from the clusters 302, 303 and 304. An optional control means may again be used to adjust the respective output intensity of the clusters 302, 303 and 304, and optionally of their respective light-emitting elements 306, 308 and 310, to thereby adjust and substantially maintain an output colour balance and/or output intensity of the light source 300.

Each cluster 302, 303 and 304 may also optionally comprise primary optics, and optionally secondary optics, for directing light emitted thereby to the light source output, which may again comprise a window, a lens, a diffuser, one or more filters and the like. The person of skill in the art will again readily understand that various output optics may be considered in the present example, whether they be integral or external to the various light-emitting clusters 302, 303 and 304, to provide similar results, and as such, should not be considered to be outside the intended scope of the present disclosure.

Example 4

Figure 5:
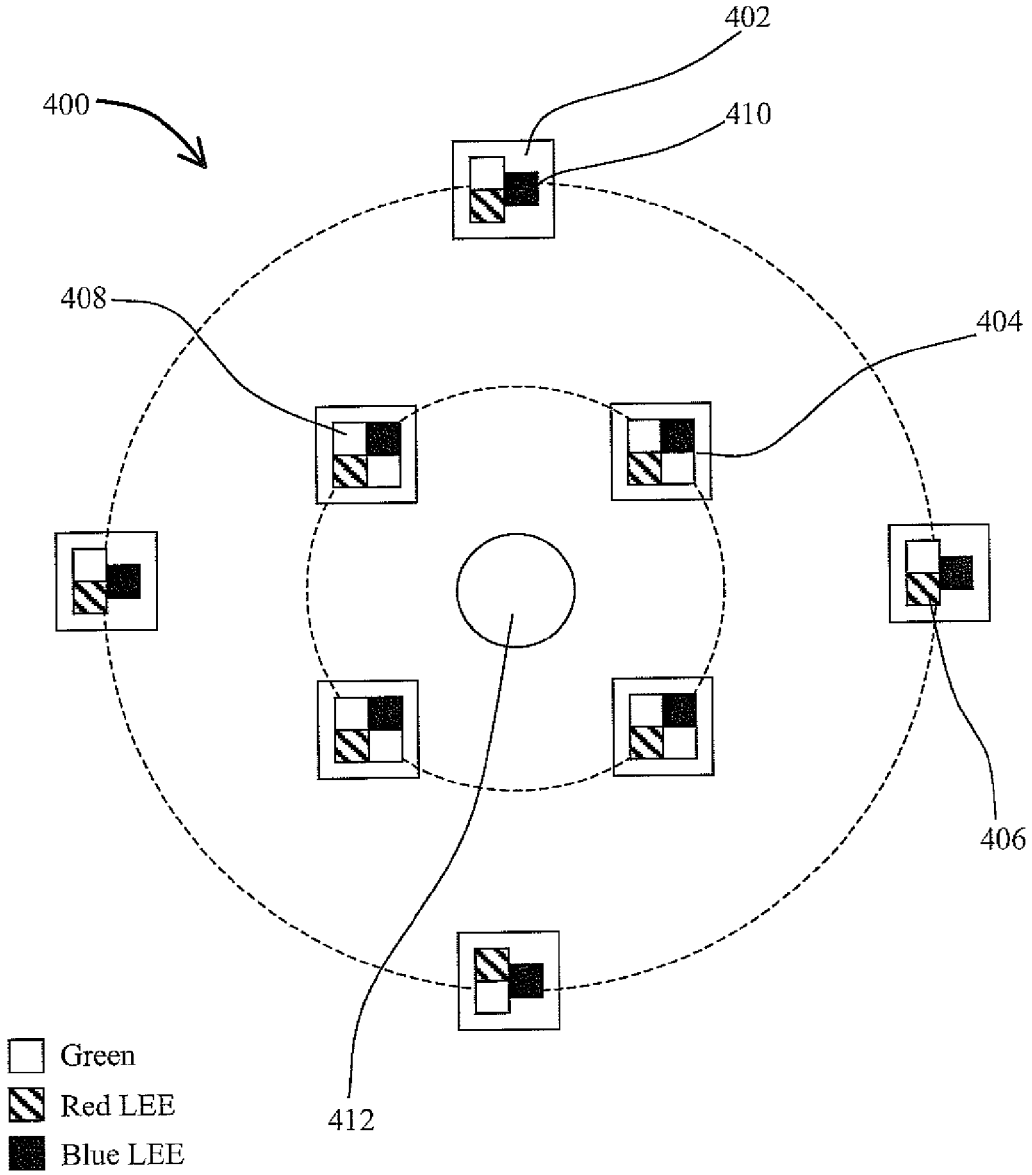
FIG. 5 is a diagrammatical top plan view of a light source comprising light-emitting clusters, in accordance with another embodiment of the present invention.

Referring now to FIG. 5, a light source, generally referred to using the numeral 400 and in accordance with an embodiment of the present invention, will now be described. The light source 400 generally comprises eight light-emitting clusters, four each of a first type of cluster, as in cluster 402, and of a second type of cluster, as in cluster 404. Light-emitting clusters 402 and 404 are each comprised of red, green and blue light-emitting elements, as in elements 406, 408 and 410, respectively, wherein in this particular embodiment an output intensity (or output efficiency) of the blue light-emitting elements 410 is about 1.5 times higher than that of the green light-emitting elements 408 and about equal to that of the red light-emitting elements 406. As such, to provide a substantially balanced output (e.g. balanced white light) at a substantially optimal output intensity, light-emitting clusters 402 each comprise one each of a red light-emitting element 406, a green light-emitting element 408 and a blue light-emitting element 410, whereas light-emitting clusters 404 each comprise one each of a red light-emitting element 406 and a blue light-emitting element 410 and two green light-emitting elements 408, resulting in a R:G:B ratio of about 2:3:2.

Other considerations discussed in relation to the design and manufacture of the light source 100 of Example 1 may also apply to light source 400, as will be readily understood by the person skilled in the art. For instance, the light-emitting clusters 402 and 404 may be mounted on a substrate together with respective and/or shared driving elements and comprise respective and/or shared thermal management systems to dissipate heat from the light-emitting clusters 402 and 404 and respective light-emitting elements 406, 408 and 410 thereof. In this example, the clusters 402 and 404 are arranged in a concentric circular design around an optional optical sensor 412 positioned on the centre axis of the light source 400 so to both collect and detect the light emitted from the clusters 402 and 404. An optional control means may again be used to adjust the respective output intensity of the clusters 402 and 404, and optionally of their respective light-emitting elements 406, 408 and 410, to thereby adjust and substantially maintain an output colour balance and/or output intensity of the light source 400.

Each cluster 402 and 404 may also optionally comprise primary optics, and optionally secondary optics, for directing light emitted thereby to the light source output, which may again comprise a window, a lens, a diffuser, one or more filters and the like. The person of skill in the art will again readily understand that various output optics may be considered in the present example, whether they be integral or external to the various light-emitting clusters 402 and 404, to provide similar results, and as such, should not be considered to be outside the intended scope of the present disclosure.

Example 5

Figure 6:
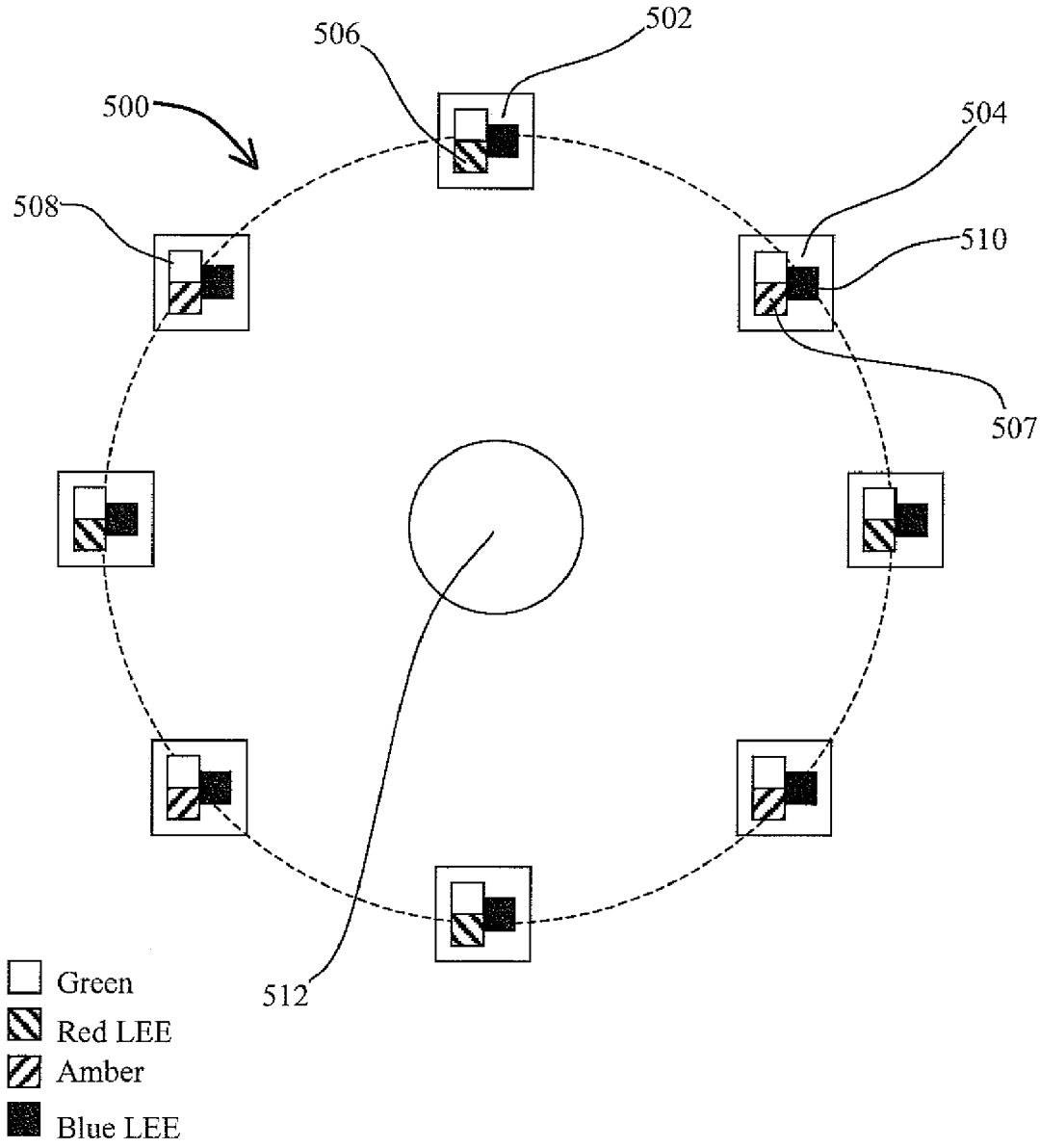
FIG. 6 is a diagrammatical top plan view of a light source comprising light-emitting clusters, in accordance with another embodiment of the present invention.

Referring now to FIG. 6, a light source, generally referred to using the numeral 500 and in accordance with an embodiment of the present invention, will now be described. The light source 500 generally comprises eight light-emitting clusters, four each of a first type of cluster, as in cluster 502, and of a second type of cluster, as in cluster 504. Light-emitting clusters 502 are each comprised of red, green and blue light-emitting elements, as in elements 506, 508 and 510, respectively, whereas light-emitting clusters 504 are each comprised of amber, green and blue light-emitting elements, as in elements 507, 508 and 510, respectively. The combination of clusters 502 and 504 can thus be expressed as RGB+AGB, wherein both red and amber light-emitting elements are provided and combined so to achieve a substantially balanced output at a substantially optimal output intensity.

In this example, compensation and balance between clusters 502 and 504 is not specifically associated with a compensation for differing output efficiencies, but rather for a refinement of the spectral contribution in the red-amber region of the visible spectrum by these clusters in order to achieve a desired spectral output defined by substantially balanced white light. The compensation between red and amber light-emitting elements in this example is similar to the contribution of the red and green light-emitting elements of different peak output wavelengths ($R_1$, $R_2$, $G_1$, $G_2$) to the substantially balanced output of the light source 200 of Example 2.

As discussed in relation to the design and manufacture of the light source 100 of Example 1, other considerations may also apply to light source 500, as will be readily understood by the person skilled in the art. For instance, the light clusters 502 and 504 may be mounted on a substrate together with respective and/or shared driving elements and comprise respective and/or shared thermal management systems to dissipate heat from the light-emitting clusters 502 and 504 and respective light-emitting elements 506, 507, 508 and 510 thereof. In this example, the clusters 502 and 504 are arranged in a circular design around an optional optical sensor 512 positioned on the centre axis of the light source 500 so to both collect and detect the light emitted from the clusters 502 and 504. An optional control means may again be used to adjust the respective output intensity of the clusters 502 and 504, and optionally of their respective light-emitting elements 506, 507, 508 and 510, to thereby adjust and substantially maintain an output colour balance and/or output intensity of the light source 500.

Each cluster 502 and 504 may also optionally comprise primary optics, and optionally secondary optics, for directing light emitted thereby to the light source output, which may again comprise a window, a lens, a diffuser, one or more filters and the like. The person of skill in the art will again readily understand that various output optics may be considered in the present example, whether they be integral or external to the various light-emitting clusters 502 and 504, to provide similar results, and as such, should not be considered to be outside the intended scope of the present disclosure.

Example 6

Figure 7:
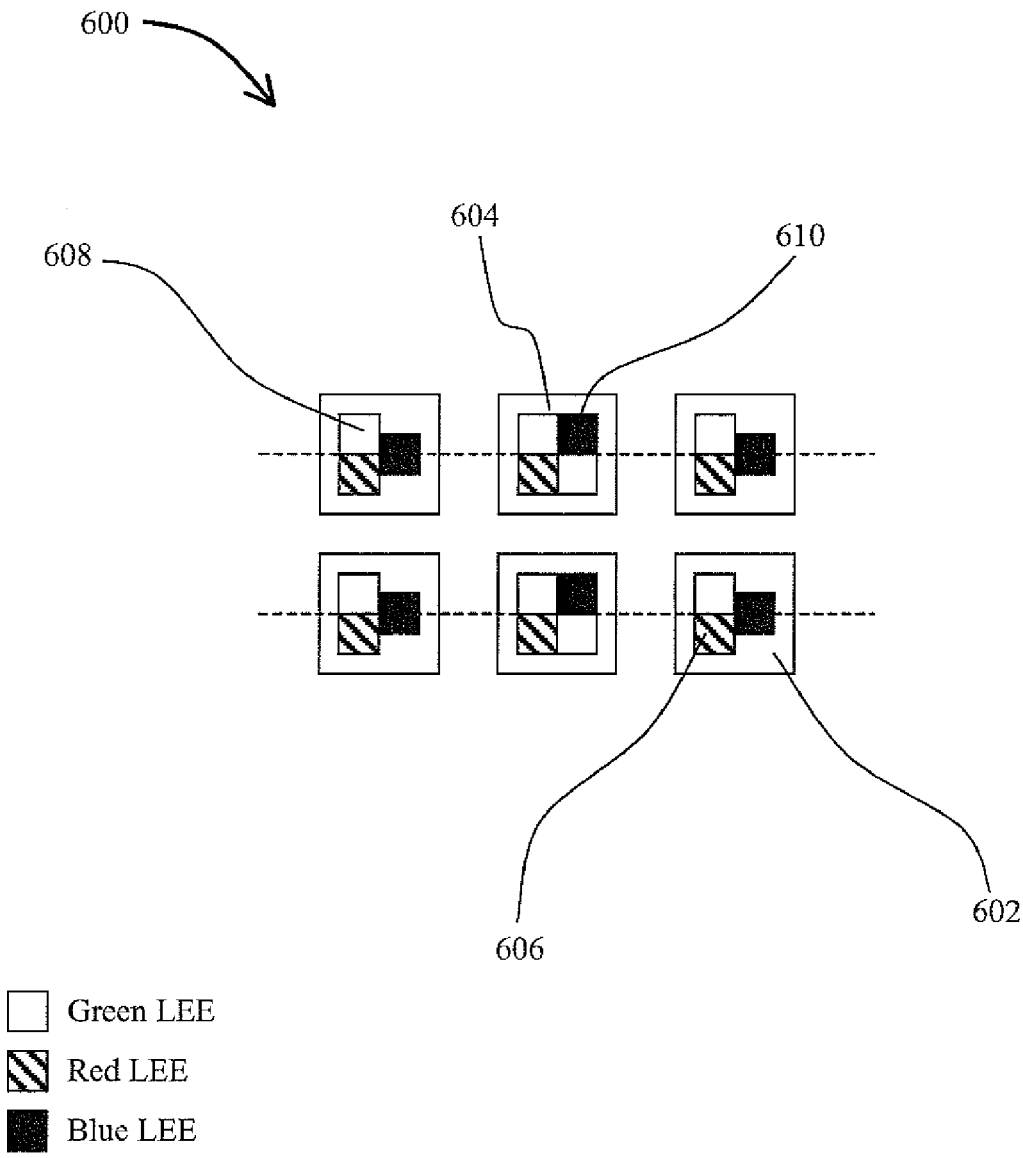
FIG. 7 is a diagrammatical top plan view of a light source comprising light-emitting clusters, in accordance with another embodiment of the present invention.

Referring now to FIG. 7, a light source, generally referred to using the numeral 600 and in accordance with an embodiment of the present invention, will now be described. The light source 600 generally comprises six light-emitting clusters, four of a first type of cluster, as in cluster 602, and two of a second type of cluster, as in cluster 604. Light-emitting clusters 602 and 604 are each comprised of red, green and blue light-emitting elements, as in elements 606, 608 and 610, respectively, wherein in this particular embodiment an output intensity (or output efficiency) of the blue light-emitting elements 610 is about 1.33 times higher than that of the green light-emitting elements 608 and about equal to that of the red light-emitting elements 606. As such, to provide a substantially balanced output (e.g. balanced white light output) at a substantially optimal output intensity, light-emitting clusters 602 each comprise one each of a red light-emitting element 606, a green light-emitting element 608 and a blue light-emitting element 610, whereas light-emitting clusters 604 each comprise one each of a red light-emitting element 606 and a blue light-emitting element 610 and two green light-emitting elements 608, resulting in a R:G:B ratio of about 3:4:3.

Other considerations discussed in relation to the design and manufacture of the light source 100 of Example 1 may also apply to light source 600, as will be readily understood by the person skilled in the art. For instance, the light-emitting clusters 602 and 604 may be mounted on a substrate together with respective and/or shared driving elements and comprise respective and/or shared thermal management systems to dissipate heat from the light-emitting clusters 602 and 604 and respective light-emitting elements 606, 608 and 610 thereof. In this example, the clusters 602 and 604 are arranged in a linear design. Optional sensing and control means not included in this example, may however be considered herein to adjust and substantially maintain an output colour balance and/or output intensity of the light source 600.

Primary and/or secondary optics may again be used for directing light emitted by the clusters 602 and 604 to the light source output, which may again comprise a window, a lens, a diffuser, one or more filters and the like. The person of skill in the art will readily understand that various output optics may be considered in the present example, whether they be integral or external to the various light-emitting clusters 602 and 604, to provide similar results, and as such, should not be considered to be outside the intended scope of the present disclosure.

The person of skill in the art will understand that the foregoing embodiments of the invention are examples and can be varied in many ways. Such present or future variations are not to be regarded as a departure from the spirit and scope of the invention, and all such modifications as would be apparent to one skilled in the art are intended to be included within the scope of the following claims.

We claim:

1. A light source for producing a spectral output at an output intensity, the light source comprising:

one or more light-emitting clusters of a first type, each one of which comprising a first combination of one or more light-emitting elements in each of at least a first, a second and a third colour;

one or more light-emitting clusters of a second type, each one of which comprising a second combination of one or more light emitting elements in one or more of said first, said second and said third colour, and wherein each of said light-emitting clusters of said second type comprises one or more light-emitting elements in each of said first, said second and said third colour; and a driving element for driving said light-emitting clusters;

wherein, when driven at the output intensity, the spectral output is provided by a combined spectral output of said one or more light-emitting clusters of said first type and said one or more light-emitting clusters of said second type.

2. The light source according to claim 1, wherein said driving element is configured to drive each of said light-emitting clusters via a substantially same drive current intensity.

3. The light source according to claim 1, further comprising a control element operatively coupled to said driving element, configured to adjust a drive signal to said first type relative to said second type in order to improve the spectral output.

4. The light source according to claim 3, wherein said control element is configured to improve said spectral output from being within a first tolerance of an ideal spectral output to being within a second tolerance of said ideal spectral output.

5. The light source according to claim 3, further comprising a sensing element operatively coupled to said control element for sensing an output of the light source and communicating a signal representative thereof to said control element for further controlling an output of said clusters in response thereto.

6. The light source according to claim 1, wherein the spectral output comprises white light having a colour rendering index above a pre-selected threshold value.

7. The light source according to claim 1, wherein a respective number of said light-emitting elements in each of said first, said second and said third colour is selected as a function of a respective colour-dependent output efficiency thereof.

8. The light source according to claim 7, wherein a ratio of said respective number of said light-emitting elements in a given colour to that of another colour is about equal to a ratio of said respective colour-dependent output efficiency of said light-emitting elements in said other colour to that of said given colour.

9. The light source according to claim 7, wherein a ratio of said respective number of said light-emitting elements in a given colour to that of another colour is proportional to a ratio of said respective colour-dependent output efficiency of said light-emitting elements in said other colour to that of said given colour.

10. The light source according to claim 1, wherein said first type comprises a different number of light-emitting elements than said second type.

11. The light source according to claim 1, wherein said first type comprises a same number of light-emitting elements as said second type.

12. The light source according to claim 1, wherein said second type comprises one or more light-emitting elements in a colour other than said first, said second and said third colour.

13. A light source for producing a spectral output at an output intensity, the light source comprising:

one or more light-emitting clusters of a first type, each one of which comprising a first combination of one or more light-emitting elements in each of at least a first, a second and a third colour;

one or more light-emitting clusters of a second type, each one of which comprising a second combination of one or more light emitting elements in one or more of said first, said second and said third colour, one or more light-emitting clusters of a third type, a driving element for driving said light-emitting clusters;

wherein, when driven at the output intensity, the spectral output is provided by a combined spectral output of said one or more light-emitting clusters of said first type and said one or more light-emitting clusters of said second type, and wherein each one of said light-emitting clusters of said third type comprises a third combination of one or more light-emitting elements in one or more of said first, said second and said third colour.

14. The light source according to claim 13, wherein said first type comprises a different number of light-emitting elements than said second type.

15. The light source according to claim 13, wherein said first type comprises a same number of light-emitting elements as said second type.

16. The light source according to claim 13, wherein said second type comprises one or more light-emitting elements in a colour other than said first, said second and said third colour.

17. The light source according to claim 13, wherein said driving element is configured to drive each of said light-emitting clusters via a substantially same drive current intensity.

18. A light source for producing a spectral output at an output intensity, the light source comprising:

one or more light-emitting clusters of each of a first type and of one or more other types; and a driving element for driving said one or more light-emitting clusters of said first type and of said one or more other types;

each cluster of said first type comprising one or more light-emitting elements in each of at least a first, a second and a third colour having respective output efficiencies, wherein one or more of said respective output efficiencies are lower than one or more others of said respective output efficiencies; and each cluster of said one or more other types comprising one or more light-emitting elements selected to compensate for said one or more lower respective output efficiencies such that, when driven to provide the output intensity, a spectral output of said one or more light-emitting clusters of said first type is substantially balanced by a spectral output of said one or more light-emitting clusters of said one or more other types.

19. The light source according to claim 18, wherein a ratio of a number of said light-emitting elements of a given colour to a number of said light-emitting elements of another colour is inversely proportional to a ratio of said respective output efficiencies thereof.

20. The light source according to claim 18, wherein a ratio of a number of said light-emitting elements of a given colour to a number of said light-emitting elements of another colour is about equal to an inverse ratio of said respective output efficiencies thereof.

21. The light source according to claim 18, further comprising a control element operatively coupled to said drive element and configured to control an output intensity of said one or more clusters of said first type relative to that of said one or more other types in order to improve the spectral output.

22. The light source according to claim 18, further comprising a control element operatively coupled to said drive element and configured to control an output intensity of said light-emitting elements relative to one another in order to improve the spectral output.

23. The light source according to claim 22, wherein said control element provides a fine tuning of the spectral output a coarse tuning of which being provided by a combination of said one or more clusters of said first type with said one or more clusters of said one or more other types.

24. The light source according to claim 23, further comprising a sensing element operatively coupled to said control element for sensing an output of said light source and communicating a signal representative thereof to said control element for further controlling an output of said clusters in response thereto.

25. The light source according to claim 18, wherein said spectral output comprises white light.

26. The light source according to claim 25, wherein said white light is defined by a colour rendering index above a pre-selected threshold value.

* * * * *